US005235916A

United States Patent [19]

Winger

[11] Patent Number: 5,235,916

[45] Date of Patent: Aug. 17, 1993

[54] WARHEAD DIRECTED-CHARGE POSITIONER SYSTEM

[75] Inventor: Thomas M. Winger, Upland, Calif.

[73] Assignee: Hughes Missile Systems Company, Tucson, Ariz.

[21] Appl. No.: 519,720

[22] Filed: Jan. 10, 1966

[51] Int. Cl.[5] ..... F42B 12/10

[52] U.S. Cl. ..... 102/475; 102/211; 102/476

[58] Field of Search ..... 102/70.2, 70.2 P, 211, 102/213, 214, 215, 475, 476; 244/3.16, 3.17, 3.19

[56] References Cited

U.S. PATENT DOCUMENTS

| | | | |
|---|---|---|---|
| 2,697,400 | 12/1954 | Liljegren | 102/476 |
| 2,925,965 | 2/1960 | Pierce | 102/211 |
| 3,002,455 | 10/1961 | Jarnholt | 102/476 |
| 3,136,251 | 6/1964 | Witow | 102/211 |
| 3,157,124 | 11/1964 | Müller | 102/476 |

OTHER PUBLICATIONS

Locke, *Guidance*, Van Nostrand Co., Inc.; 1955; p. 607.

*Primary Examiner*—Charles T. Jordan

*Attorney, Agent, or Firm*—Charles D. Brown; Randall M. Heald; Wanda K. Denson-Low

[57] ABSTRACT

Broadly the disclosure relates to a warhead positioner system which includes a warhead construction comprising a cylindrical missile section having a sector-shaped ordnance charge forming one quadrant thereof, means supporting said missile section for rotational movement about the longitudinal axis of the missile, torque motor means for controlling the rotational position, and means conducting electrical signals to said torque motor from an electric seeker head whereby the charge is positioned so as to be directed toward a desired target upon being detonated. Further, the electrical signal conducting means comprise digital-type circuitry responsive to the electric seeker head output for positioning the charge in one of four quadrants and further analog circuitry for positioning the charge in either half of the selected quadrant.

10 Claims, 3 Drawing Sheets

WARHEAD DIRECTED-CHARGE POSITIONER SYSTEM

This invention relates generally to shaped- or directed-charge warheads for missiles or the like, and particularly to a positioner system for warheads utilizing shaped- or directed-charges.

The present known ordnance philosophy of missiles, for example of the surface-to-air type, is based on a guided projectile which detonates a warhead in the proximity of the target. The warhead generally has a fragmentation pattern extending radially three hundred sixty degrees about the axis of the missile microwave fuzing systems sight an extremity of a target and then detonate the warhead after a predetermined depth of penetration has been reached. Thus, when the warhead explodes, only a small portion of its force is used in disabling the target while the remainder of the force thereof is discharged into space and is not effective.

The positioner system of this invention aligns a shaped- or directed-charge type warhead with an angular position about the longitudinal axis of a missile or the like which coincides with the angular position of the target within the roll plane of the missile. Thus the energy of the warhead is concentrated in the target area and not expelled radially about the missile as in the prior known methods.

Therefore, it is an object of this invention to provide a warhead positioner.

A further object of the invention is to provide a positioner system for shaped- or directed-charge type warheads.

Another object of the invention is to provide a positioner system which aligns a shaped- or directed-charge type warhead with an angular positioner about the longitudinal axis of a missile or the like which coincides with the angular position of the target within the roll plane of the missile.

Another object of the invention is to provide a shaped- or directed-charge warhead positioner system for a missile which utilizes proportional navigation wherein the intelligence relative to the angular position of the target about the longitudinal axis of the missile is used for positioning the directed-charge of the warhead.

Another object of the invention is to provide a shaped- or directed-charge warhead which is mounted in a missile for rotation about the longitudinal axis thereof and rotated by drive motor means activated when commands are received and when an error signal is present in the position servo loop of the missile target seeker system.

Other objects of the invention will become readily apparent from the following description and accompanying drawings wherein.

Figure 2:
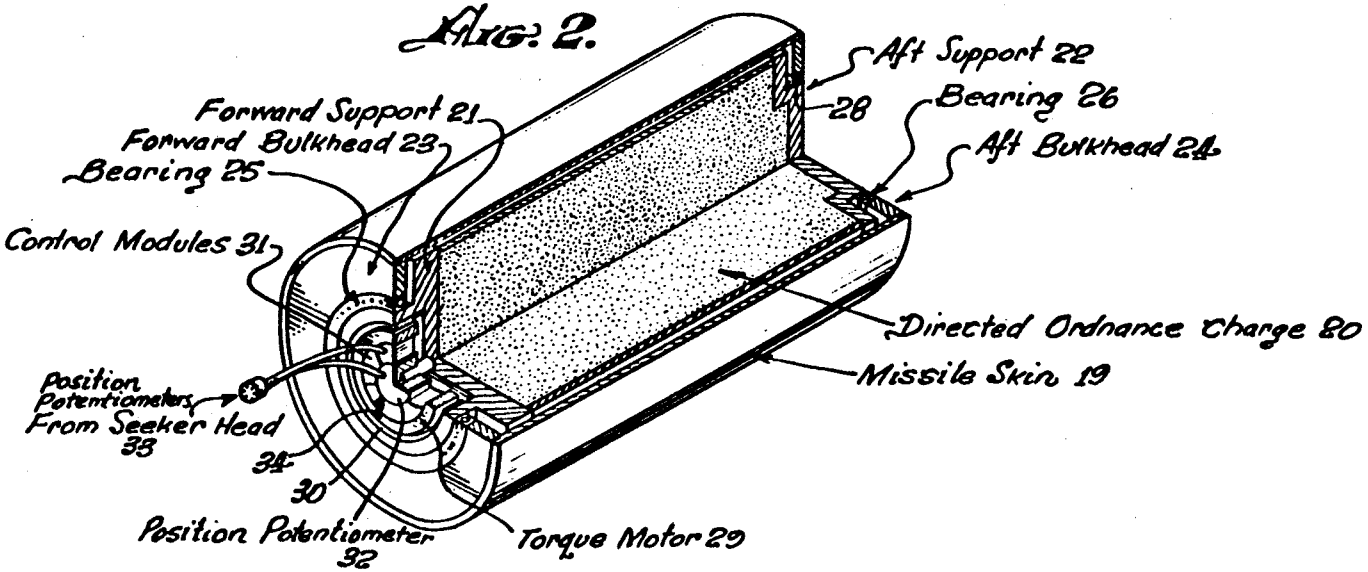
FIG. 2 is a partial view of the ordnance section of the FIG. 1 missile with portions thereof being cut away to illustrate the directed charge warhead.
Figure 5:
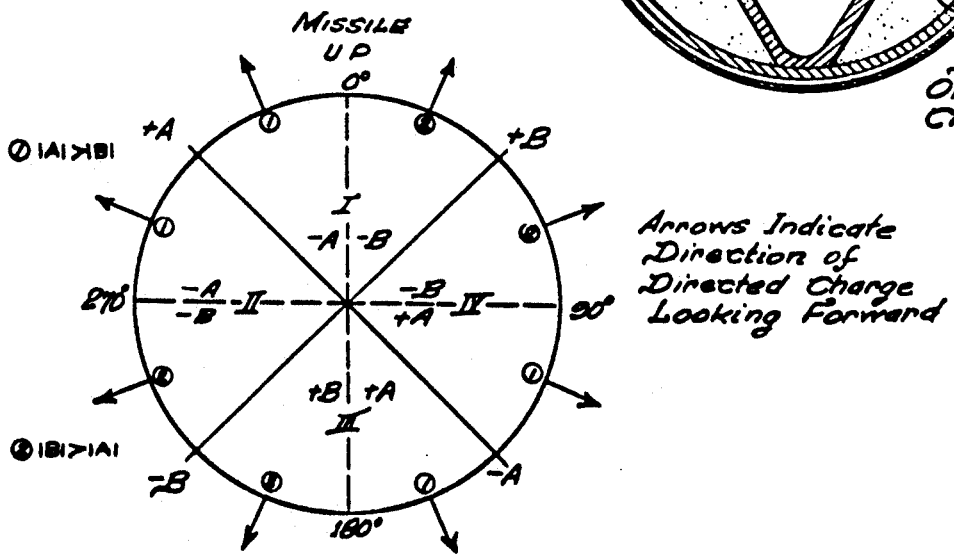
Figure 6:
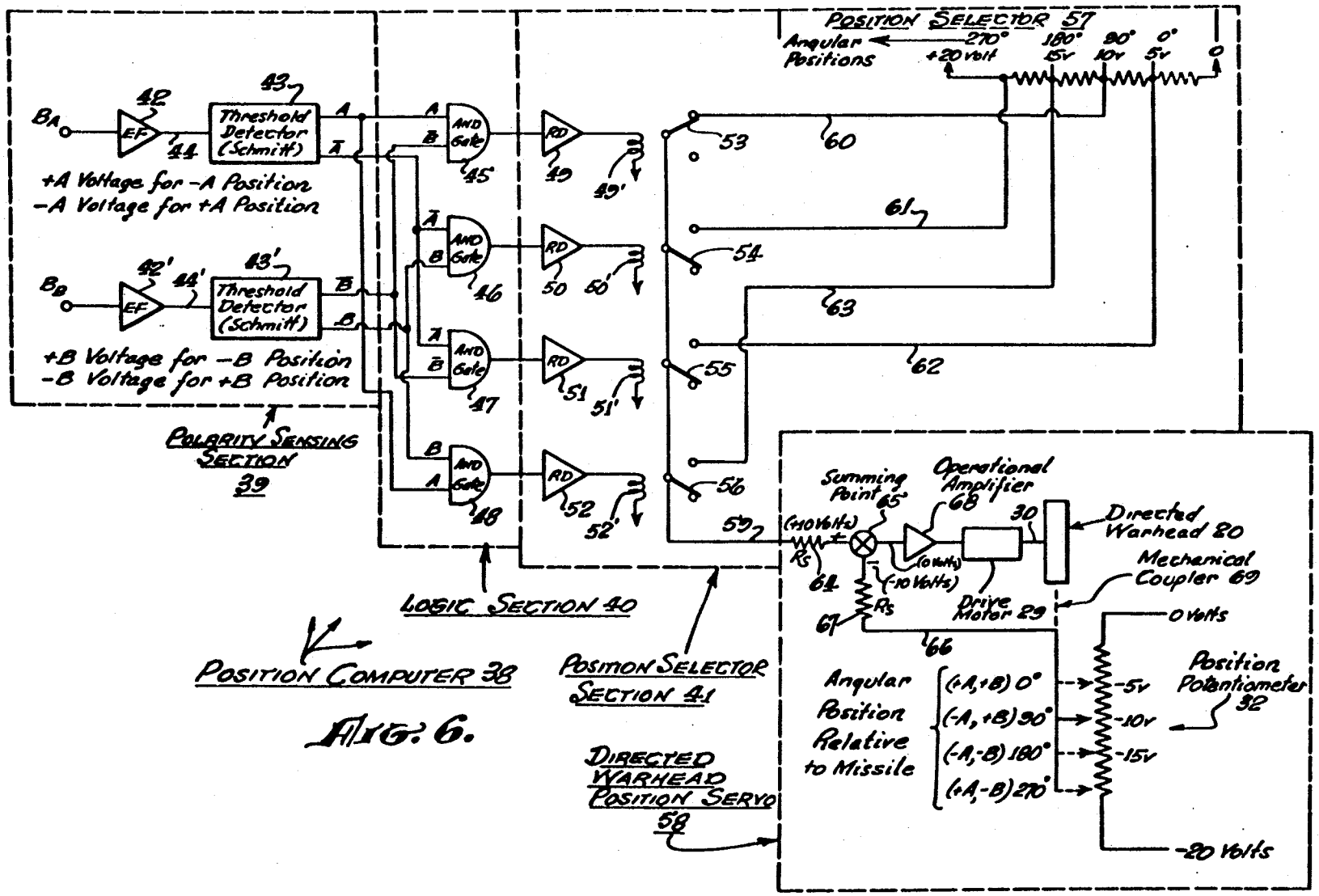

FIG. 5 diagrammatically illustrates the positioning of the FIG. 2 warhead with respect to the missile seeker line of sight about the longitudinal axis of the missile; and FIG. 6 schematically illustrates exemplary electrical circuitry for the inventive positioner system.

Figure 1:
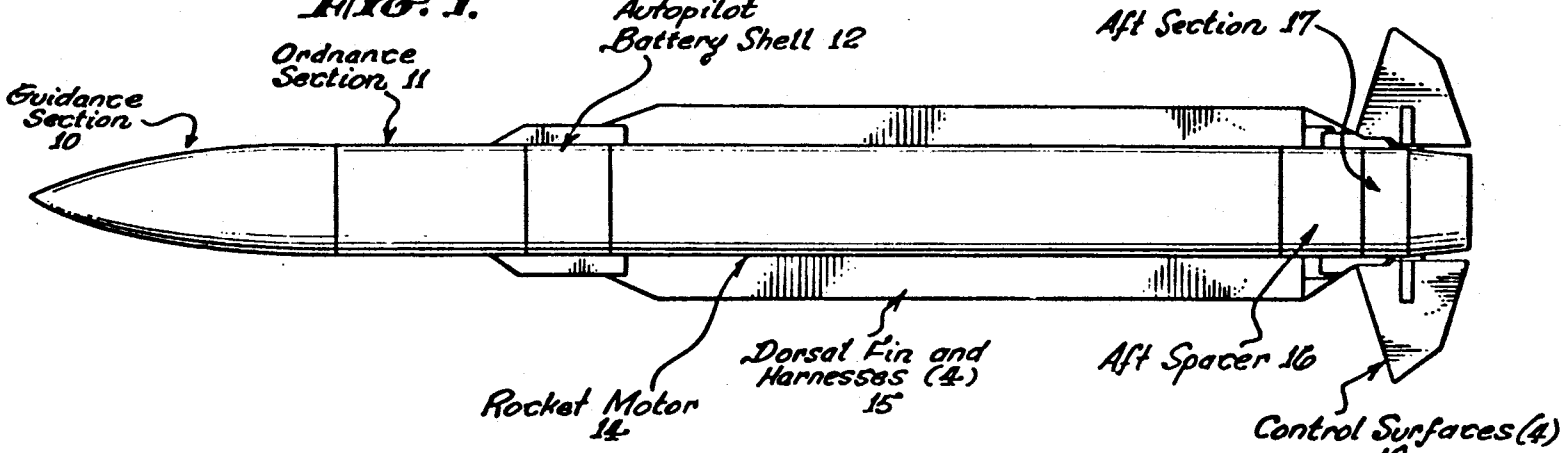
FIG. 1 is a perspective view of a missile incorporating the invention.

Referring now to the drawings, FIG. 1 shows a missile basically comprising a guidance section 10, ordnance section 11, autopilot battery shell 12, rocket motor 14, dorsal fin and harnesses 15 (only two being shown), aft spacer 16, aft section 17, and control surfaces 18 (only two being shown).

The ordnance section 11 is partially shown in FIG. 2 and generally comprises an ordnance shroud or missile skin 19 within which is located a directed or shaped ordnance charge 20. Charge 20 is provided with a forward support member 21 and an aft support member 22 which support charge 20 in shroud 19 intermediate a forward bulkhead 23 and an aft bulkhead 24 via bearings 25 and 26, which may be of the 4-point contact ball bearing type. Bulkheads 23 and 24 may be connected to shroud 19 in a conventional manner (not shown). Bearing 25 cooperates with a flange portion 27 of forward support member 21 while bearing 26 cooperates with a protruding portion 28 of aft support member 22. A torque motor 29 is coaxially positioned within flange 27 of forward support 21 and is drivingly connected to the flange 27 via a member 30. A plurality of control modules indicated at 31 are positioned coaxially within torque motor 29 and encompass a position potentiometer 32. Electrical leads indicated generally at 33 extend from the seeker head position potentiometers and are connected to certain of the modules 31 and position potentiometer 32. Electrical connections indicated at 34 interconnect certain of modules 31 with torque motor 29.

Figure 3:
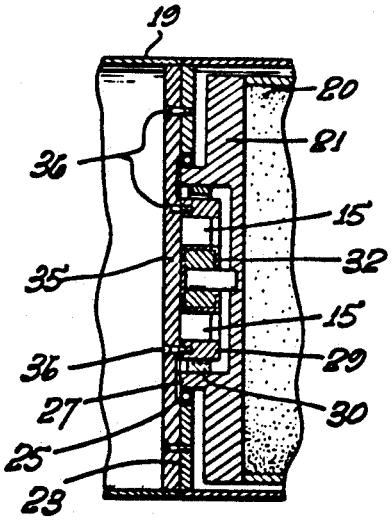
FIG. 3 is a cross-sectional view illustrating the mechanism for attaching the FIG. 2 warhead to the FIG. 1 missile.
Figure 4:
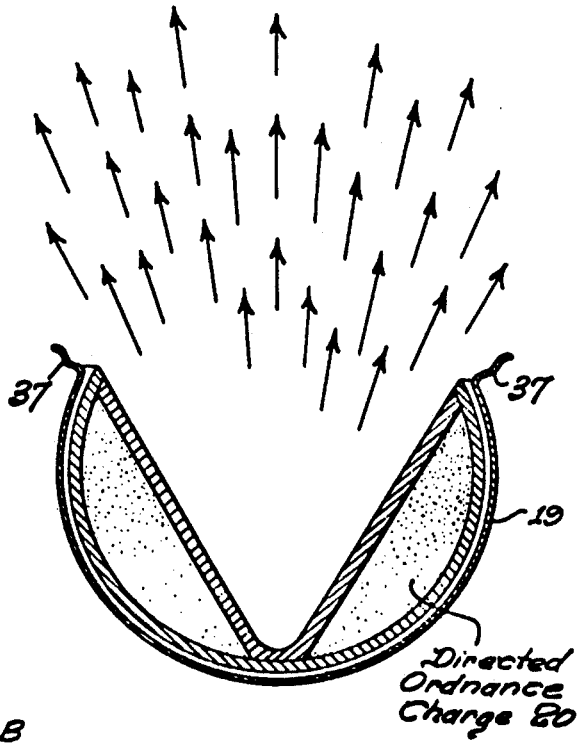
FIG. 4 illustrates the basic shaped-charge or directed-charge of the FIG. 2 warhead.

As seen in FIG. 3, the forward bulkhead 23 and torque motor 29 are fixedly attached to a structural support 35 via screws or the like 36. The support 35 is constructed so as to support the outer race of bearing 25 while being relieved at the area adjacent the bearing, flange 27, and driven member 30 so as not to interfere with the rotation of these elements and the associated charge 20 when actuated by torque motor 29 in response to signals from position potentiometer 32. Thus, with the charge 20 positioned in response to signals from the seeker head position potentiometers, the charge 20 is ignited by a fuse mechanism (not shown) whereby, the force of the charge is directed in a desired direction and ruptures the shroud or missile skin 19 as indicated at 37 and is directed toward the target as indicated by the arrows in FIG. 4.

As set forth above, the system of this invention positions the shaped- or directed-charge warhead 20 in a plane perpendicular to the missile longitudinal axis in accordance with commands derived from the position of seeker head which constitutes part of the guidance section 10 and may, for example, be of the electric type which is moved in response to signals received by an antenna arrangement. The information available from the position potentiometers on the seeker head is used to command the position of the shaped- or directed-charge warhead such that the charge thereof may be directed to an angular position within, for example, 20°-25° of the projected angular position of the seeker head line-of-sight (L.O.S.) about the longitudinal axis of the missile. In this system, a position servomechanism is used to rotate the warhead in a plane perpendicular to the missile longitudinal axis, the position to which the warhead is rotated being determined from the seeker head position potentiometer with digital logic.

Referring now to FIG. 5, the position of the seeker head of guidance section 10 is resolved into two planes indicated as A and B when looking forward from the aft end of the missile. The output of the position potentiometer in each plane may for example be one volt for each 3° of look angle (negative for a positive look-angle and positive for a negative look-angle). Therefore, by comparing both sign and magnitude of the two potentiometers, described in detail hereinafter, the shaped- or directed-charge warhead can be positioned in the position most likely to result in a "kill".

The warhead can be rotated to any one of eight separate positions as shown in FIG. 5. A comparison of the signs of the A and B plane voltages determines whether the target is in quadrant I, II, III, or IV. A comparison of the magnitudes of the two voltages determines whether the target is in the upper or the lower half of the quadrant as indicated by the arrows (1) and (2). When the magnitude of the A plane voltage is greater than the magnitude of the B plane voltage, the position in a quadrant is indicated by arrow (1). Thus, when the magnitude of the B plane voltage is greater than that of the A plane voltage, the warhead position is indicated by arrow (2). For example, with the ratio set forth above, if the seeker head were pointed at a target with a look-angle of +30° in the A plane and −9° in the B plane, the output of the A plane potentiometer would be −10 volts and the output of the B plane potentiometer would be +3 volts. A comparison of the polarity of these two voltages would show the target to be in quadrant II (− voltage from A and + voltage from B). A comparison of the magnitudes of the two potentiometer voltages (A is greater than B) would show the target to be in the upper half of quadrant II indicated by arrow (1). The shaped- or directed-charge warhead would, therefore, be positioned so that the charge would be directed radially from position (1) of quadrant II.

It is thus seen that this invention as illustrated and described sets forth the general manner of positioning a warhead in eight (8) positions about a missile, as shown in FIG. 5, as well as the detailed manner of positioning the warhead in four (4) positions about a missile, as shown in FIG. 6. The intelligence to determine the positions is derived from the seeker head control plane position potentiometer voltage as set forth below in the description of the four (4) position logic circuitry of FIG. 6. For the purpose of simplicity of description, only a four (4) position system has been illustrated in FIG. 6. However, the eight (8) position arrangement of FIG. 5 could be accomplished by logic circuitry similar to the manner in which the circuitry and components are illustrated in FIG. 6. The number of control positions will be dependent on the logic circuitry in the design or, basically, the complexity of the position computer illustrated in FIG. 6. The circuitry and components illustrated in FIG. 6 are encompassed within modules 31, torque motor 29 and position potentiometer 32 of FIG. 2.

Referring now to FIG. 6, the position computer 38 consists of three (3) subsections: the polarity sensing section 39, a logic section 40 to determine one of a number of circuits to close, and a position selector section 41 to supply an output voltage to be summed in a position servo 58 proportional to an angular position about the missile longitudinal axis.

The polarity sensing section 39 utilizes the signals $B_A$ and $B_B$ received from position potentiometers (not shown) of the seeker head of guidance section 10 via leads 33 (FIG. 2) to determine the angular position that the target is located relative to the missile. Section 39 consists of a pair of emitter followers 42 and 42' which prevent loading of the seeker head position potentiometer, and a pair of threshold detectors (Schmitt Triggers) 43 and 43' electrically connected to emitter followers 42 and 42', respectively, via connections 44 and 44' to sense the polarity of the signal. Threshold 43 has outputs indicated at A and $\overline{A}$ while threshold 43' outputs are indicated at B and $\overline{B}$. The thresholds 43 and 43' are set at a level above the noise to eliminate continual switching due to noise. For a positive input signal into the threshold detectors 43 and 43', the A or B output voltages would be positive and for a negative input signal, the $\overline{A}$ or $\overline{B}$ output voltages would be positive.

The logic section 40 consists of four AND-gates 45, 46, 47 and 48. AND-gate 45 is electrically connected to the A output of threshold 43 and the $\overline{B}$ output of threshold 43'. AND-gate 46 is electrically connected to the $\overline{A}$ output of threshold 43 and the B output of threshold 43' AND-gate 47 is electrically connected to the $\overline{A}$ output of threshold 43 and the $\overline{B}$ output of threshold 43'. AND-gate 48 is electrically connected to the A output of threshold 43 and to the B output of threshold 43'. An AND-gate requires all inputs to be positive before the output of the gate becomes positive. The AND-gates 45, 46, 47 and 48 are electrically connected via relay drivers (amplifiers) 49, 50, 51 and 52 with relays 49', 50', 51' and 52', respectively, of the position selector section 41 and function to cause one of the four relays 49'-52' to be energized. Thus, a positive signal out of any of the AND-gates 45-48 turns on the associated relay driver 49-52 which energizes the relay 49'-52' in the same branch. Energization of any one of the relays 49'-52' causes an associated switch blade 53, 54, 55 and 56, respectively, to move from the open position (shown by blades 54, 55, 56) to the closed position (shown by blade 53).

Position selector section 41 also includes a position selector 57 which comprises a voltage divider and controls the amplitude of voltage output of the position computer 38 which is directed to a position servo 58 via connection 59. The voltage steps of the selector 57 correspond to angular positions about the missile, as illustrated in FIG. 6. Selector 57 is electrically connected with relays 49', 50', 51' and 52' via respective connections 60, 61, 62 and 63.

The voltage output signal from position selector 57 of the position computer 38 is directed via connection 59 through a resistor 64 to a summing point 65 wherein the signal is compared with a signal via a connection 66 and resistor 67 from the position potentiometer 32, and an output signal, if any, is thereafter directed through an operational amplifier 68 to the drive or torque motor 29 which as explained above with respect to FIG. 2 positions the shaped- or directed-charge warhead 20 via mechanical connection 30. When the directed warhead 20 has an angular motion, the voltage output of the position potentiometer 32 varies and has a negative polarity due to the mechanical coupler 69 therebetween. When the computer positive voltage via 59 and the servo potentiometer feedback voltage via 66 and 67 are equal the voltage to the operational amplifier 68 is zero and the torque motor 29 stops and the warhead 20 is in the compared position.

In operation, by way of example, if the look angle of the seeker head of the guidance section 10 is at a $-30°$ in the A plane and at a $+15°$ in the B plane of FIG. 5, the voltage would be $+A$ and $-B$ in the A plane and B plane, respectively. Therefore, the angular position of the target would be 90° or quadrant IV in FIG. 5. The only AND-gate that will pass a voltage to a position relay is gate 45 since this is the only gate that can be activated by an A and $\overline{B}$ signal as seen in FIG. 6. When this voltage activates relay 49' via amplifier 49, the computer 38 output at 59 will be a positive 10 volts and correspond to a missile angular position of 90° as shown by the position selector 57. This positive 10 volt input to the position servo 58 will activate the drive or torque motor 29 if the warhead 20 is not positioned at the missile angular position of 90°. Until the warhead position potentiometer 32 has a negative voltage of 10 volts, which corresponds to the missile angular position of 90°, the motor 29 will operate. The torque or drive motor will stop when the algebraic sum of the command voltage (voltage via 59) and the warhead position potentiometer voltage (voltage via 66 and 67) is zero at the output of the summing point 65.

It is thus seen that this invention provides a system wherein the intelligence relative to the angular position of the target about the longitudinal axis of a missile or the like is utilized to position a shaped- or directed-charge type warhead so as to increase the "kill" probability of the target. As shown, this intelligence is available in terms of control planes and requires resolution to obtain information relative to the roll plane of the missile. The roll intelligence derived by digital logic from the control plane position, is used to command a position servo which drives the shaped- or directed-charge warhead. The directed-charge warhead is mounted on bearings and is coupled to the missile shroud about the longitudinal axis by a drive motor. The drive motor is activated when commands are received and when an error signal is present in the position servo loop. Thus the energy of the warhead upon detonation is concentrated in the target area and not expelled radially about the missile.

While the description of the invention has been directed to a warhead positioned in response to the guidance section of an air vehicle such as a missile, the concept of this invention may be incorporated into underwater vehicles such as a torpedo wherein intelligence relative to the angular position of the target about the longitudinal axis of the vehicle is available to position the warhead.

Although a particular embodiment of the invention has been illustrated and described, modifications and changes will become apparent to those skilled in the art, and it is intended to cover in the appended claims all such modifications and changes as come within the true spirit and scope of the invention.

WHAT I CLAIM IS:

1. In combination: a warhead and a vehicle for transporting the warhead; said vehicle including at least a guidance section, an ordnance section, and a propulsion section; said guidance section including means for directing said vehicle toward an associated target; said warhead being located in said ordnance section and being of the directed-charge type; said warhead being mounted within said ordnance section for selective rotational movement about the longitudinal axis of said vehicle from a normally stationary position; and means for controlling the rotational position of said warhead in response to signals from said vehicle directing means, whereby said directed-charge type warhead is so positioned that the energy thereof upon detonation is concentrated in the area of an associated target.

2. The combination defined in claim 1, wherein said warhead position controlling means includes a torque motor means, and wherein said signals are electrical signals, said warhead position controlling means also including means for conducting said electrical signals to said torque motor means from said vehicle directing means.

3. The combination defined in claim 2, wherein said electrical signal conducting means includes a position computer portion and a warhead position servo portion.

4. The combination defined in claim 3, wherein said position computer portion consists of a polarity sensing section, a logic section, and a position selector section, the output signal of said position selector section being fed to said warhead position servo portion.

5. The combination defined in claim 4, wherein said position servo portion includes a summing means, an amplifier means and a position potentiometer means, whereby an output signal from said selector section of said computer portion is fed to said torque motor means through said summing means and said amplifier means for activating said torque motor and rotating said warhead, and whereby a certain amount of rotation of said warhead causes said position potentiometer means to produce a feedback signal which is directed to said summing means, and whereby rotation of said warhead is stopped upon said feedback signal cancelling said output signal.

6. The combination defined in claim 1, wherein said warhead includes a pair of end support members, one of said end support members being provided with a shoulder means for rotational support within said ordnance section of said vehicle via bearing means, said other of said pair of end support members being provided with a flange portion, the external surface of said flange portion serving as a rotational support within said ordnance section via bearing means.

7. The combination defined in claim 6, wherein said warhead position controlling means includes a torque motor means, said torque motor means being located at least partially within said flange portion of said other end support member.

8. The combination defined in claim 7, wherein said warhead position controlling means additionally includes means for conducting said signals to said torque motor means from said vehicle directing means, said signals being electrical signals, said means for conducting said signals being located at least partially within said torque motor means.

9. The combination defined in claim 8, wherein said means for conducting said signals includes electronic module means and a position potentiometer means.

10. The combination defined in claim 9, wherein said electronic module means is located intermediate said position potentiometer means and said torque motor means.

* * * * *